United States Patent [19]

Kelly

[11] Patent Number: 4,862,656

[45] Date of Patent: Sep. 5, 1989

[54] SECURITY POSTS

[76] Inventor: Eamonn W. J. Kelly, 23 Grange Park Crescent, Raheny, Dublin 5, Ireland

[21] Appl. No.: 244,104

[22] Filed: Sep. 14, 1988

[30] Foreign Application Priority Data

Sep. 14, 1987 [IE] Ireland ..... 2466/87

[51] Int. Cl.[4] ..... E04H 12/22

[52] U.S. Cl. ..... 52/165; 52/297; 52/298; 248/553; 70/62

[58] Field of Search ..... 52/165, 296, 297, 298; 248/551, 553; 70/55, 62, 158, 159, 163, 167, 168, 169, 235, 181

[56] References Cited

U.S. PATENT DOCUMENTS 4,567,740 2/1986 Kelly ..... 70/55

FOREIGN PATENT DOCUMENTS 1064912 8/1959 Fed. Rep. of Germany ..... 52/297
1246484 2/1968 United Kingdom ..... 52/298
1252927 11/1971 United Kingdom .
2125084 7/1986 United Kingdom .

*Primary Examiner*—David A. Scherbel
*Assistant Examiner*—Jerrold D. Johnson
*Attorney, Agent, or Firm*—Oblon, Fisher, Spivak, McClelland & Maier

[57] ABSTRACT

A security post assembly consisting of a base tube to be sunk into the ground or other base and a post which fits into the mouth of the tube is lockable by a mortise lock mounted inside the post above ground level. The bolt of the lock protrudes outside the post and into a receiver structure carried on the underside of a cover plate which is hinged to the base tube and which can be swivelled to stand up beside the post. The receiver structure comprises a U-shape flange which fits inside a U-shape guard plate attached to the post.

7 Claims, 2 Drawing Sheets

SECURITY POSTS

BACKGROUND OF THE INVENTION

1. Field of the Invention

The present invention relates to improvements in security post assemblies of the type used to block driveways, gateways, roads, car park entrances and the like, or as additional protection in front of windows or doors of business premises.

2. Description of the Related Art

In my U.S. Pat. No. 4,567,740 (European Patent Application No. 0,104,939) I have described and shown in FIGS. 14–17 a security post assembly comprising a base tube adapted to be sunk into the ground or other base, and a post which fits into the mouth of the tube, wherein a cover plate fixed to an arm hinged to the base tube is adapted to be swivelled with the arm between a covering position in which it covers the mouth of the tube and an upright position in which it stands beside a padlock housing secured to the post so that part of the arm enters a slot in the padlock housing and an aperture provided in that part of the arm engages the bolt of the padlock.

Although this security post assembly has been well received, there is also a demand for an assembly which offers the additional security of a mortise lock hidden within one of the components of the assembly.

British Patent Specification No. 2,125,084B describes a security post assembly in which a mortise lock is housed within the post in a position such that the lock bolt, when extended, protrudes through a wall of the post and engages a receiver in the base tube. However the lock bolt and the receiver in the base tube are both then located below ground level and are therefore subject to rust and corrosion. Furthermore the base tube described in GB No. 2,125,084B has a light weight removable cover plate which is easily lost or stolen and may then leave a dangerous hole in the ground when the mouth of the base tube is left uncovered. Alternatively a lightweight hinged cover could be used but such a cover can be easily damaged by vehicles and people may trip over it, when the security post has been removed.

SUMMARY OF THE INVENTION

The present invention provides a security post assembly comprising a base tube adapted to be sunk into the ground or other base and having an open mouth, a post which fits into the mouth of the tube, a cover plate hingedly attached to the tube so as to be swingable to a raised position in which it permits entry of the post into the tube, and a locking mechanism mounted inside the post having a bolt adapted to be extended through an aperture in a wall of the post, wherein the cover plate carries on its underside a receiver structure to receive the bolt and the locking mechanism is located in such a position in the post that the bolt is extendable into the receiver when the cover plate is in the raised position.

Preferably the receiver structure comprises at least a flange projecting downwardly from the cover plate, preferably at right angles thereto, at the end thereof remote from the hinge attachment to the tube. More preferably the receiver structure comprises three flange portions forming a U-shape structure. Alternatively, or in addition the post may carry a U-shape guard projecting therefrom around the aperture. Preferably the two U-shape structures are complementary. In a preferred embodiment, one of the U-shape structures carries a vertically orientated projection which is insertable in an aperture in the other U-shape structure.

Preferably the locking mechanism comprises a mortise lock, key-operated from outside the post.

BRIEF DESCRIPTION OF THE DRAWINGS

A security post assembly in accordance with the present invention will now be described in further detail with reference to the accompanying drawings in which.

DESCRIPTION OF THE PREFERRED EMBODIMENTS

Figure 1:
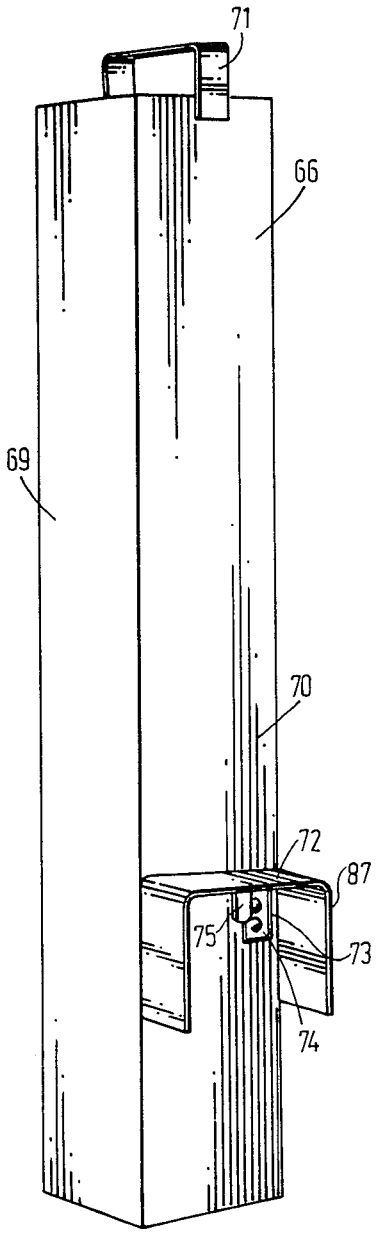
FIG. 1 is a perspective view of the post of a security post assembly in accordance with the present invention.
Figure 2:
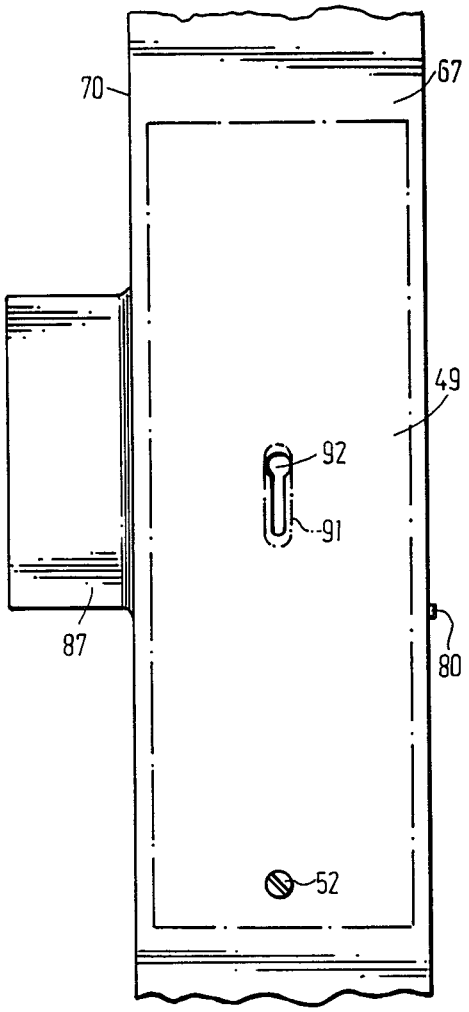
FIG. 2 is a side elevation of part of the post from the opposite side.

As shown in the drawings, a post 70 with four vertical faces 66, 67, 68, 69 has a handle 71 to enable the post to be lifted and lowered. An inverted U-shaped guard plate 72 is welded to one side of the post just above a hole 73 through which the bolt 74 of a mortise lock can slide. A locating pin 75 projects downwardly from the roof portion of the guard plate 72.

The post 70 has a stop 80 on the face 68 opposite to that which carries the guard plate 72. The stop 70 and the bottom edge of the guard plate 72 limit the extent to which the post 70 is inserted into tube 79.

The mortise lock 83 is located inside the post 70 in a lower region thereof, just above the stop 80 and generally level with the cover plate in its raised position. The lock is mounted on a support plate 49 which fits inside the post. The plate 49 has a spacer flange 50 extending at right angles therefrom, near to the top of the plate. This spacer flange has an area slightly less than the cross-sectional area of the interior of the post so that the flange holds the plate 49 against one wall 67 of the post. The plate 49 is secured inside the post by a screw-bolt 52 which passes through the wall 67 of the post, below the level of the stop 80, and engages a nut 53. The plate can be easily removed from the post, for maintenance or replacement of the locking mechanism, by unscrewing the screw-bolt 52. However the head of the screw-bolt 52 is inaccessible when the post is mounted in the base tube.

The mortise lock 83 has a front plate 85 which is secured to two right-angle brackets 90 by means of screw-bolts 88. The brackets 90 in turn are welded to the inner face of the support plate 49, so that the lock 83 is fixed to the support plate but spaced by about 5 mm from the inner face thereof. The lock, which is preferably a 5-lever or 7-lever security lock, has its keyhole 94 aligned with a corresponding keyhole 91 in plate 49 and a corresponding keyhole 92 in wall 67 of the post, so that the lock can be operated by a key from outside the post. The lock 83 has a conventional flat lock-bolt 74 which slides horizontally out of the front plate 85 when the key is turned and passes through the hole 73 in wall 66 of the post, to the position shown in FIG. 4.

The base tube 79 (see FIG. 3) has a cover plate 76 which carries on its underneath surface a U-shaped flange 81. The cover plate is hingedly attached to an outwardly projecting portion 78 of the base tube 79 by a hinge rod 77 passing through the side limbs 86 of the flange 81. When the cover plate is in its lowered position (not shown in the drawings), the flange 81 is received inside the open mouth 93 of the tube 79 and the cover plate 76 rests on top of the tube.

Figure 3:
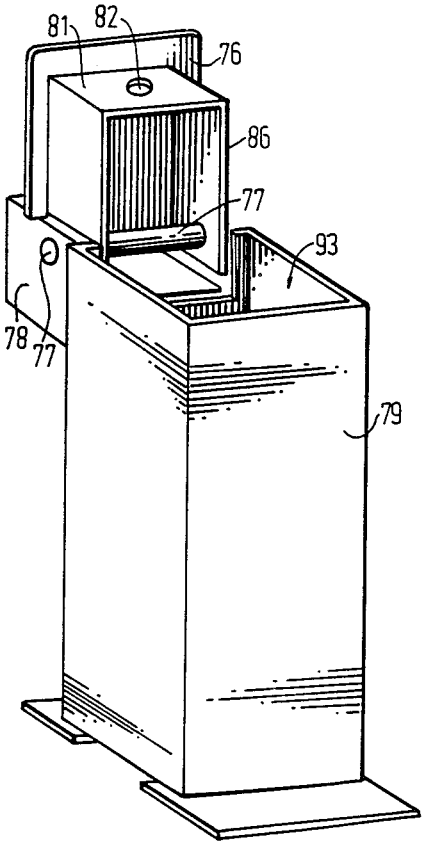
FIG. 3 is a perspective view (from the opposite direction as compared to FIG. 1) of the base tube of a security post assembly, for use with the post of FIGS. 1 and 2, showing the cover plate in a raised position.
Figure 4:
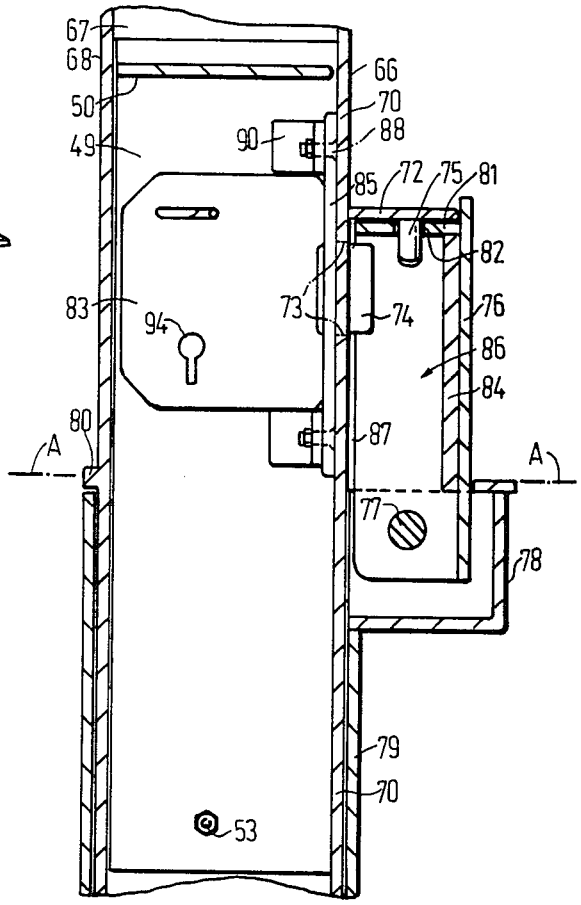
FIG. 4 is a longitudinal cross section (on a mid plane parallel to the elevation of FIG. 2 but viewed from the opposite direction) of a portion of the assembly formed by fitting the post of FIGS. 1 and 2 into the base tube of FIG. 3.

When the cover plate is swivelled up to its raised position shown in FIGS. 3 and 4, it permits the post 70 to be lowered into the tube 79 until stop 80 and guard 72 prevent further downward movement of it. The cover plate stands up beside the post 70 and the upper part of the flange structure 81 on the cover plate 76 fits neatly within the downwardly-open guard plate 72 on the post. One side limb 86 of the flange 81 fits between one side limb 87 of the guard plate and the aperture 73. The locating pin 75 on the guard plate 72 enters into a hole 82 in the roof portion of the flange 81. This arrangement is seen in FIG. 4.

The cover plate 76 and its U-shaped flange 81 define a protected receiver structure for receiving lock-bolt 74 of the mortise lock 83. When a key is turned to operate the mortise lock 83, the lock-bolt 74 travels through hole 73 in the wall 66 of the post and extends into the space inside the receiver structure. If an attempt is then made to lift the post 70 out of the tube 79, the lock-bolt 74 comes into contact with the top portion of the flange 81 and therefore upward movement is prevented. Nevertheless in the normal working position of the assembly, as shown in FIG. 4, the lock-bolt 74 is not subject to any loading or stress. The guard plate 72 reinforces the protection provided by the U-shape flange 81 and prevents any access to the lock-bolt 74 by unscrupulous persons trying to tamper with the locked assembly. Locating pin 75 also prevents the cover plate 76 being forced away from the guard plate 72.

The mortise lock remains above ground level (shown by line A—A in FIG. 4) and therefore is less susceptible to rust and corrosion than if it was located in a part of the post which enters into the tube. The keyhole 92 is spaced above ground level and is more accessible than it would be if the lock were in a lower position in the post.

The cover plate 76, with its flange 81, is of a heavier and more robust construction than the cover plates in prior art security post assemblies. A plate 84 may be secured on the underneath face of the cover plate 76, inside the flange 81, to weight the cover plate structure to one side of hinge 77, and to strengthen the cover plate structure. When the post is not in use, the cover plate 76 lies flat on the top edge of the base tube and is not easily dislodged.

I claim:

1. A security post assembly comprising a base tube adapted to be sunk into the ground or other base and having an open mouth, a post which fits into the mouth of the tube, a cover plate hingedly attached to the tube so as to be swingable to a raised position in which it permits entry of the post into the tube, and a locking mechanism inside the post having a bolt adapted to be extended through an aperture in a wall of the post, wherein the cover plate carries on its underside a receiver structure to receive the bolt and the locking mechanism is located in such a position in the post that the bolt is extendable into the receiver structure from inside said post when the cover plate is in the raised position.

2. An assembly according to claim 1 wherein the receiver structure comprises a flange projecting downwardly from the cover plate at the end thereof remote from the hinge attachment to the tube.

3. An assembly according to claim 2 wherein the receiver structure comprises three flange portions forming a U-shape structure.

4. An assembly according to claim 1, wherein the post carries a U-shape guard projecting therefrom around the aperture.

5. An assembly according to claim 2 wherein the receiver structure comprises three flange portions forming a U-shape structure and the post carries a U-shape guard projecting therefrom around the aperture, the two U-shape structures being complementary.

6. An assembly according to claim 5 wherein one of the U-shape structures is provided with a vertically orientated projection which is insertable in an aperture in the other U-shape structure.

7. An assembly according to claim 1 wherein the locking mechanism comprises a mortise lock, key-operable from outside the post.

* * * * *